US005316398A

United States Patent [19]

Chandaria et al.

[11] Patent Number: 5,316,398

[45] Date of Patent: May 31, 1994

[54] COMBINATION BOTTLE AND STICK

[75] Inventors: Kapoor Chandaria, Kampala, Uganda Uganda; Benjamin H. Stansbury, Jr., King City; Robert G. Dickie, Newmarket, both of Canada

[73] Assignee: Conros Corporation, Scarborough, Canada

[21] Appl. No.: 26,325

[22] Filed: Mar. 4, 1993

[51] Int. Cl.[5] ..... B65D 21/02

[52] U.S. Cl. ..... 401/18; 215/6; 215/10; 132/297; 132/318; 401/52; 401/19

[58] Field of Search ..... 132/297, 318; 401/18, 401/52, 19; 215/10, 6; 206/581, 514

[56] References Cited

U.S. PATENT DOCUMENTS

| | | | |
|---|---|---|---|
| 251,566 | 12/1881 | Fuller | 215/6 |
| 4,235,343 | 11/1980 | Thompson | 215/10 |
| 4,950,083 | 8/1990 | Bavaveas | 215/10 X |
| 5,065,875 | 11/1991 | Balavich | 215/10 |
| 5,135,116 | 8/1992 | Panzetti | 215/10 |

FOREIGN PATENT DOCUMENTS

| | | | |
|---|---|---|---|
| 169859 | 6/1934 | Switzerland | 132/318 |

*Primary Examiner*—Steven A. Bratlie
*Attorney, Agent, or Firm*—Jeffrey T. Imai; Arne I. Fors; D. Doak Horne

[57] ABSTRACT

In combination, a molded bottle and a stick dispenser wherein the bottle comprises front and rear faces and side edges. One of the side edges has a cavity for nesting the stick dispenser. The stick dispenser has end surfaces and the cavity has end surfaces. Each of the end surfaces of the stick dispenser has a recess and each of the ends of the cavity has a domed surface. The domed surfaces are sized and spaced to receive each of the recesses of the stick dispenser in a snap fit.

17 Claims, 3 Drawing Sheets

COMBINATION BOTTLE AND STICK

FIELD OF INVENTION

This invention relates to a combination bottle container and stick container/dispenser. In particular, this invention relates to a bottle container having a cavity for releasably retaining the stick type container/dispenser.

BACKGROUND OF INVENTION

Many liquid or semi-liquid products, such as glues, hand lotions, shampoos, are bottled in plastic containers or bottles. Plastic provides a lightweight inexpensive method of marketing a product. Plastic bottles come in a variety of sizes and shapes, from cylindrical to oval to rectangular.

Many other products, such as glues, cosmetics, lipsticks and lip balms and antiperspirants, are contained within a tube or stick type container or dispenser. The stick container will advance the product out of the container as the consumer uses the product. Such stick dispenser/container are described in U.S. Pat. No. 3,912,403.

For many marketing reasons, it is desirable to package and sell two compatible products together. However, due to the incompatible shape of the stick dispenser/container, a stick dispenser cannot be packaged with a bottled product without adding a cardboard container.

Alternatively, the two products could be wrapped in a clear plastic or cellophane wrapper and shrink-wrapped together or bonded together with a strap or tape. However, such a product would occupy excessive amount of shelf space and would be difficult to align neatly. As a result, retailers would not want to carry such products.

Further, once the consumer has unwrapped the package, the two products may become separated and any advantage for purchasing the two compatible products is lost.

In a commonly assigned co-pending application, Ser. No. 08/020,945, filed Feb. 19, 1993, the disclosure of which is hereby incorporated by reference, there is disclosed a bottle and stick dispenser combination. The bottle has a cavity in a face for nesting the stick dispenser. The bottle has retaining means for releasably retaining the dispenser within the cavity in a snap or frictional fit.

It has been found that the bottle and stick dispenser combination of the co-pending application provides a suitable marketing vehicle. However since the cavity occupies one face of the bottle, the stick dispenser must be nested within either the front face or the rear face of the product. If the stick dispenser is nested on the front face, there is very little room left for labelling the product. If the stick dispenser is nested on the rear face, the consumer will not see the uniqueness of the product when it sits on the retail shelf.

It has also been found that the molded undercut retaining means of the bottle according to the co-pending application does not provide a high degree of gripping force. The gripping force can be increased by increasing the length of the molded undercut surface. However, increasing the length of the undercut surface presents serious molding problems, making molding more difficult with a higher rate of defective products being molded.

SUMMARY OF THE INVENTION

The disadvantages of the prior art may be overcome by providing a bottle with a molded cavity in the side of the bottle for releasably retaining a stick type container/dispenser.

According to one aspect of the invention, there is provided in combination, a molded bottle and a stick dispenser wherein the bottle comprises front and rear faces and side edges. One of the side edges has a cavity for nesting the stick dispenser. The stick dispenser has end surfaces and the cavity has end surfaces. Each of the end surfaces of the stick dispenser has a recess and each of the ends of the cavity has a domed surface. The domed surfaces are sized and spaced to receive each of the recesses of the stick dispenser in a snap fit.

DESCRIPTION OF THE DRAWINGS

In figures which illustrate embodiments of the invention.

DESCRIPTION OF THE INVENTION

Figure 1:
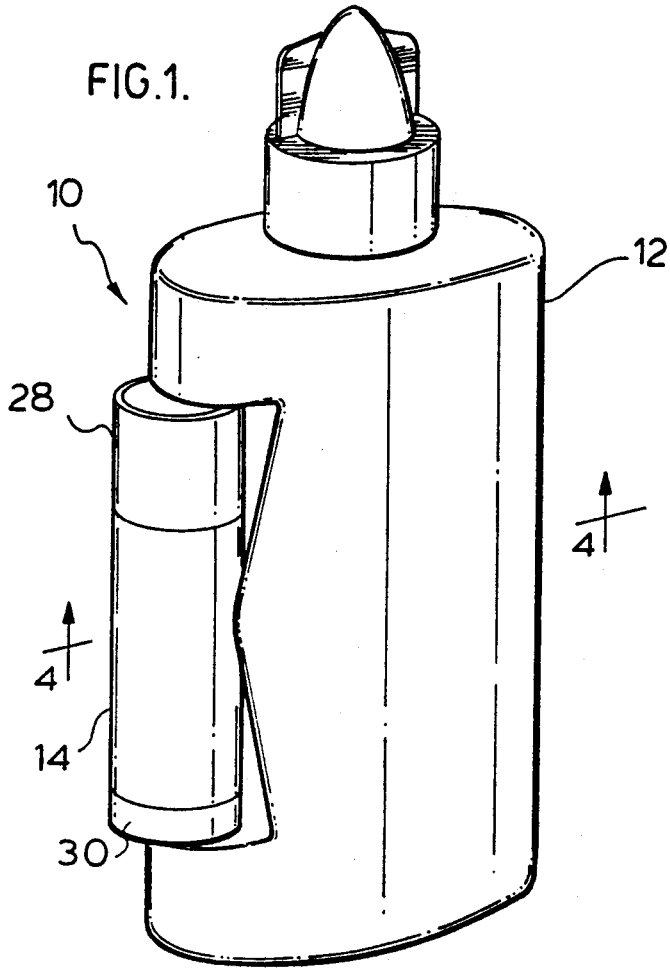
FIG. 1 is a perspective view of a bottle and stick dispenser of the first embodiment of the invention wherein the stick dispenser extends outwardly from the bottle faces.

The present invention is generally illustrated as 10 in FIG. 1. The invention includes a bottle 12 and a stick dispenser 14.

Figure 2:
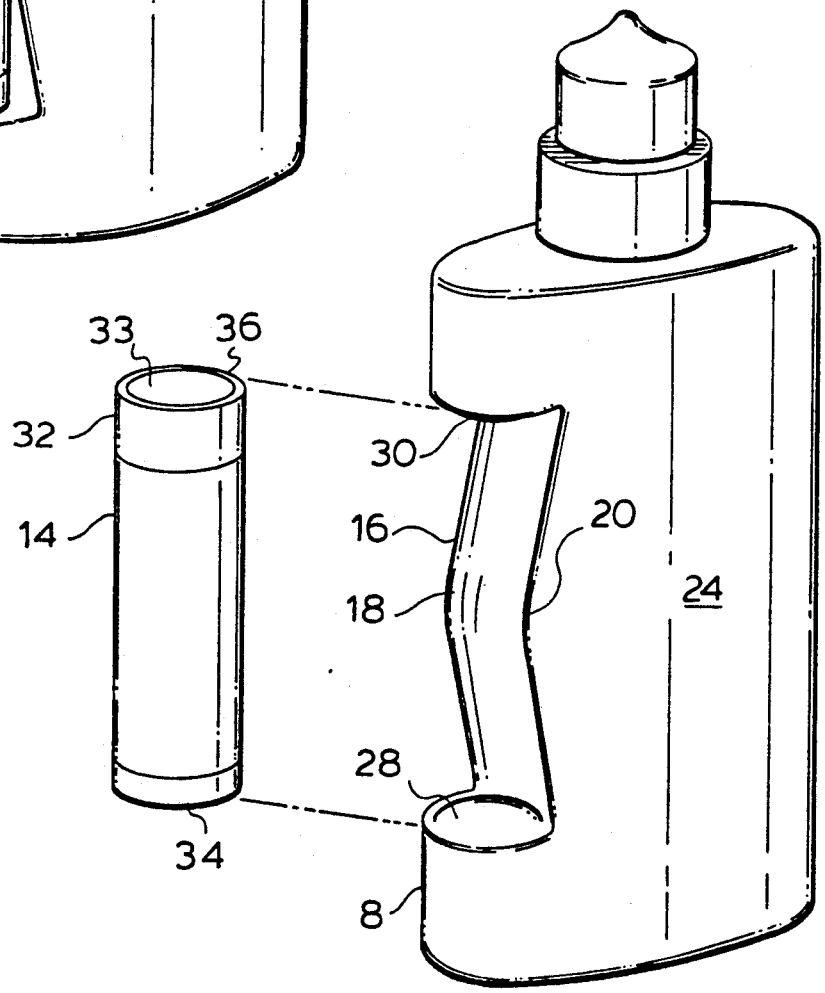
FIG. 2 is an exploded perspective view of the bottle and stick dispenser of the invention of FIG. 1.
Figure 3:
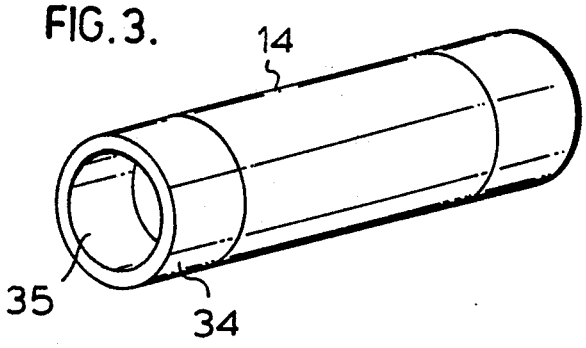
FIG. 3 is a perspective view of the stick dispenser of the invention of FIG. 1, illustrating the bottom end thereof.
Figure 4:
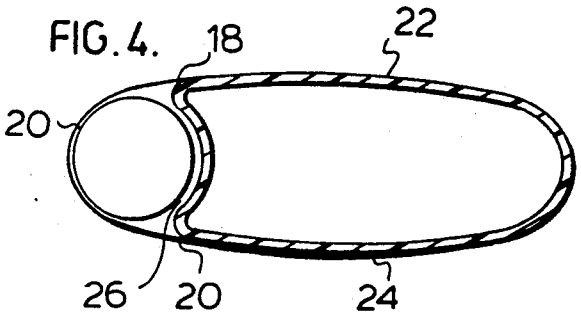
FIG. 4 is a sectional view of the bottle of the invention of FIG. 1 along the lines 1—1.

Referring to FIG. 2, bottle 12 has a cavity 16 which extends inwardly from a side edge 8. The cavity extends in a longitudinal direction of the bottle 12. The cavity 16 has an opening sized to receive and nest the stick dispenser 14. Bottle 12 may be any desirable shape, including cylindrical.

The edge of the cavity 16 has at least two flanges 18 and 20 on opposite sides thereof. The flanges 18 and 20 extend from a rear face 22 and front face 24 of the bottle, respectively. The inner faces 26 of flanges 18 and 20 are curved to cradle the stick dispenser 14.

The top and bottom ends of cavity 16 have domed surfaces 28 and 30. The domed surfaces are spaced inwardly from the inner face 26 and the front and rear faces 22 and 24.

The stick dispenser 14 can be any type of dispenser known in the art. The stick dispenser 14 has a tubular body having a cap 32 at one end and a rotatable end 34. The rotatable end 34 is the means for advancing or dispensing the material housed within dispenser 14.

The cap 32 has a recess 33 formed in top surface 36. Similarly, the rotatable end 34 has a recess 35 in the bottom end of the dispenser 14. Domed surfaces 28 and 30 are sized to complementarily engage the recesses 33 and 35 of the dispenser 14.

Cavity 16 is sized to snappingly fit the dispenser 14 into the cavity 16. A first end of dispenser is presented over a first domed surface, while the second end is levered towards the second domed surface. The second end of the dispenser will frictionally engage the second domed surface. The dispenser is urged beyond the frictional engagement until the dispenser is snappingly engaged by the bottle. To remove the dispenser, the steps are reversed.

The shape of dispenser 14 is preferably tubular but could be any shape provided the cavity 16 is shaped to nest the stick dispenser 14 and flanges 18 and 20 will cradle the stick dispenser 14.

In the first embodiment of the invention as illustrated in FIG. 1, the stick dispenser 14 will extend outwardly of the bottle. The cap 32 and the rotatable end 34 will be exposed to allow the dispenser to be easily gripped for removal. This arrangement also has the advantage that the size of cavity 16 is minimized increasing the volume of the bottle 12.

Figure 5:
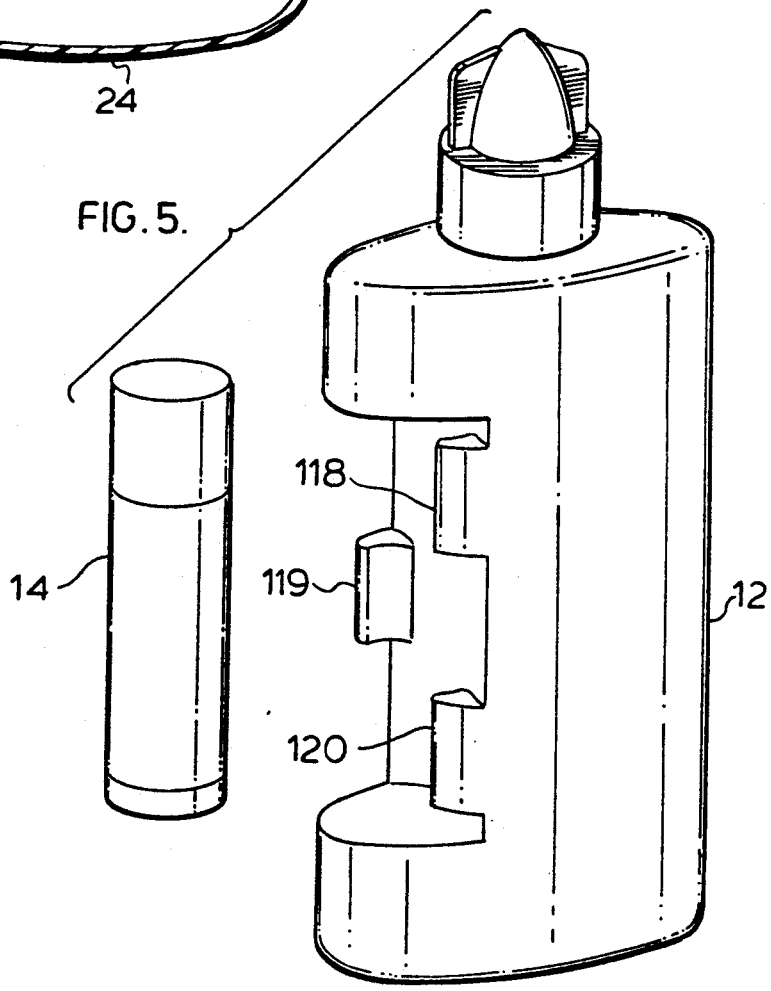
FIG. 5 is an exploded perspective view of a bottle and stick dispenser of a second embodiment of the invention wherein the bottle has offset retaining flanges.

In the second embodiment of the invention as illustrated in FIG. 5, the dispenser is flush with the front and rear faces of the bottle presenting a very smooth appearance.

Figure 6:
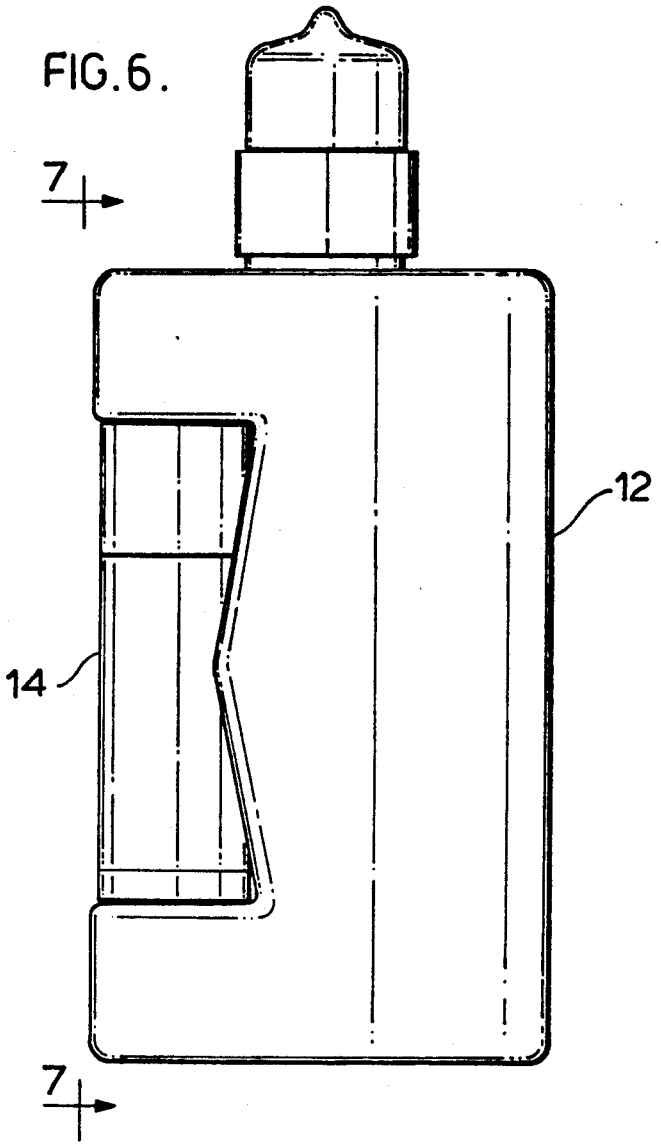
FIG. 6 is a perspective view of a bottle and stick dispenser of a third embodiment of the invention wherein the stick dispenser is stored flush with the bottle faces.
Figure 7:
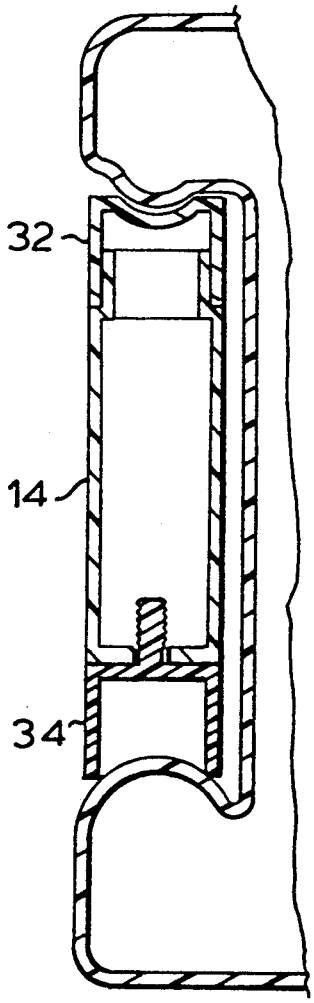
FIG. 7 is a partial sectional view of a bottle and stick dispenser of the embodiment of FIG. 6.

In the third embodiment of the invention as illustrated in FIG. 6, flanges 18 and 20 are replaced by a plurality of offset flanges 118, 119 and 120 extending from opposite sides of the cavity 16. The flanges 118, 119 and 120 will cradle the dispenser 14. More importantly, flanges 118, 119 and 120 are easier to mold than flanges 18 and 20 because the amount of undercut in the mold is minimized.

To manufacture a bottle 12, a blow molding process is used. Molds having a shape complementary to the shape of bottle 12 are manufactured in two half molds. The molds must be undercut to some extent in order to mold flanges 18 and 20. The undercut should not be excessive otherwise the bottle will not be removable from a single piece half mold. If the undercut is to be greater, then the molds will be required to be manufactured in multiple pieces to permit removal of the finished bottle.

Bottle 12 may be blow molded using any suitable polymer material. The preferred materials are olefins, and a particular polyethylene. Polyethylene is ideally suited for blow molding to produce a semi-rigid bottle.

Once the bottle 12 has been manufactured, it may be filled with a suitable substance. Similarly, the dispenser 14 may be filled with a suitable substance, ready for final packaging. Both the bottle 12 and dispenser 14 may be labelled accordingly, ready for packaging. The dispenser 14 is snap fitted into cavity 16 and the combination is ready for shipping and sale. In order to keep the two products together for additional security, the bottle 12 and dispenser 14 may be shrink-wrapped together as a single unit. Once the consumer purchases the unit, the wrapping is removed. The dispenser may be removed for use and replaced after use to keep the bottle and dispenser together.

In the preferred embodiment, the bottle 12 is filled with a white non-toxic white glue and the stick dispenser filled with a non-toxic stick glue. The combination white glue and stick glue is particularly useful for use by school age children in a craft or school environment. The two types of glues can be stored together for easy access. After use, the stick glue may be returned to the cavity of the bottle 12 and then together stored for re-use.

Other combinations of products are also envisioned by the present invention. Hand or face creams may be sold together with lip balms or lipsticks so that the two may be easily stored together. There are numerous possible combinations of products, provided one product is suited for a bottle and the other is suited for a stick type dispenser. Both products should be compatible for use together and complement each other.

It is now apparent to a person skilled in the art that numerous combinations of products could be packaged using the present invention. However, since many other modifications and purposes of this invention become readily apparent to those skilled in the art upon perusal of the foregoing description, it is to be understood that certain changes in style, size and components may be effective without a departure from the spirit of the invention and within the scope of the appended claims.

We claim:

1. In combination, a bottle and a stick dispenser wherein said bottle has a cavity for nesting said stick dispenser, said stick dispenser having a first end and an opposite end, said opposite end of the stick dispenser having a corner extending thereabout, said cavity having a first end and an opposite end, said opposite end of the cavity having a dome extending into the cavity, one of said first ends having a domed surface and the other of said first ends having a recess, whereby said fist end of the stick dispenser is presented to said first end of the cavity for revolving the opposite end of said dispenser relative to the first end of the cavity to frictionally engage the corner past the dome, releasably retaining the stick dispenser within the cavity in a snapping fit.

2. The combination as claimed in claim 1 wherein said bottle comprises a front and rear faces and side edges and said cavity extends into one of said side edges.

3. The combination as claimed in claim 1 wherein said first end of said cavity has said domed surface and said first end of the said stick dispenser has said recess.

4. The combination as claimed in claim 3 wherein said cavity and said domed surface and said dome are integrally blow molded into said bottle.

5. The combination as claimed in claim 4 wherein said bottle is semi-rigid.

6. The combination as claimed in claim 5 wherein said bottle is blow molded from an olefin material.

7. The combination as claimed in claim 1 wherein said bottle is filled with a liquid substance and said stick dispenser is filled with a solid substance, said liquid and solid substances being compatible for use with each other.

8. The combination as claimed in claim 1 wherein said bottle is filled with a liquid glue and said stick dispenser is filled with a stick glue.

9. The combination as claimed in claim 1 wherein said bottle is filled with a cosmetic lotion and said stick dispenser is filled with a lip balm.

10. In combination, a molded bottle and a stick dispenser wherein said bottle comprises front and rear faces and side edges, one of said side edges having a cavity for nesting said stick dispenser, said stick dispenser having one end having a recess and an opposite end having a corner extending thereabout, and said cavity having one end having a first domed surface and an opposite end having a second domed surface having a relatively smaller diameter than that of said first domed surface, whereby said recess of the stick dispenser is presented to said first domed surface for revolving the opposite end of said stick dispenser relative to said first domed surface to frictionally engage the corner past the second domed surface to releasably retain the stick dispenser within the cavity in a snapping fit.

11. The combination as claimed in claim 10 wherein said bottle is semirigid.

12. The combination as claimed in claim 10 whereins aid bottle is blow molded from an olefin material.

13. The combination as claimed in claim 10 wherein said bottle is filled with a liquid substance and said stick dispenser is filled with a solid substance, said liquid and solid substances being compatible for use with each other.

14. The combination as claimed in claim 10 wherein said bottle is filled with a liquid glue and said stick dispenser is filled with a stick glue.

15. The combination as claimed in claim 10 wherein said bottle is filled with a cosmetic lotion and said stick dispenser is filled with a lip balm.

16. The combination as claimed in claim 3 wherein said domed surface has a diameter greater than a diameter of said dome.

17. The combination as claimed in claim 3 wherein said domed surface has a diameter greater than a diameter of said recess, greater than the diameter of the dome.

* * * * *